US006073833A

United States Patent [19]

Desrosiers et al.

[11] Patent Number: 6,073,833

[45] Date of Patent: Jun. 13, 2000

[54] SHELF READY SHIPPING CONTAINER

[75] Inventors: Marc Desrosiers, Repentigny; Luc Jette, Laprairie; Jean-Pierre Tremblay, Charlemagne, all of Canada; Ullrich Flatmann, Lambertville; Christine Sanchez, Bridgewater, both of N.J.

[73] Assignee: McNeil-PPC, Inc., Skillman, N.J.

[21] Appl. No.: 09/257,144

[22] Filed: Feb. 24, 1999

[51] Int. Cl.[7] ..... B65D 5/54

[52] U.S. Cl. ..... 229/235; 229/164; 229/237; 229/242

[58] Field of Search ..... 229/164, 235, 229/236, 237, 242; 206/736, 746

[56] References Cited

U.S. PATENT DOCUMENTS

| | | | |
|---|---|---|---|
| D. 118,010 | 12/1939 | Broderick | 229/164 |
| 2,947,637 | 8/1960 | Fobiano | 206/746 |
| 3,884,348 | 5/1975 | Ross | 229/235 |
| 3,961,706 | 6/1976 | Roccaforte et al. | 206/736 |
| 4,113,100 | 9/1978 | Soja et al. | 229/164 |
| 4,318,474 | 3/1982 | Hasegawa | 229/242 |
| 4,488,641 | 12/1984 | Nishiguchi et al. | 229/235 |
| 4,553,666 | 11/1985 | Gullikson . | |
| 5,167,324 | 12/1992 | Miller | 229/235 |
| 5,464,151 | 11/1995 | Parker et al. | 229/226 |
| 5,651,497 | 7/1997 | Ventura et al. | 229/235 |
| 5,803,348 | 9/1998 | Verhelle | 229/125.08 |
| 5,881,884 | 3/1999 | Podosek | 229/242 |

FOREIGN PATENT DOCUMENTS

| | | | |
|---|---|---|---|
| 0 670 274 A1 | 2/1995 | European Pat. Off. . | |
| 1328464 | 4/1963 | France | 229/235 |
| 0 637 548 A1 | 2/1995 | France . | |
| 554339 | 1/1957 | Italy | 229/235 |
| 504 791 | 4/1997 | Sweden . | |
| 2 115 383 | 9/1983 | United Kingdom . | |
| 2 162 820 | 2/1986 | United Kingdom . | |
| 2 233 316 | 1/1991 | United Kingdom . | |
| 2 278 341 | 11/1994 | United Kingdom . | |
| WO 98/18368 | 5/1998 | WIPO . | |

*Primary Examiner*—Gary E. Elkins

[57] ABSTRACT

The present invention relates to a container configured for shipping, storing, and displaying goods. The container comprises upper and lower portions linked by a continuous line of weakness, wherein the upper portions collectively form a container top section that can be easily and cleanly removed and disposed, while the lower portions collectively form a container bottom section that is retained for displaying contained articles. The container employs materials and design features that provide satisfactory protection during transportation, clamping and stacking.

19 Claims, 3 Drawing Sheets

SHELF READY SHIPPING CONTAINER

FIELD OF THE INVENTION

The present invention relates to a shipping container that provides satisfactory protection during transportation and storage, and is easily and efficiently manipulated to display contained articles for sale.

BACKGROUND OF THE INVENTION

The resources required for maintaining shelf stock and appearance can be significant. A traditional method of maintaining shelf stock consists of one or more individuals transporting a container of goods from a storage area to a display area, opening the container, and then removing the articles from the container and placing them onto a shelf. This method is very inefficient.

Moreover, although the articles are typically placed onto the shelves by hand in a very orderly manner, consumer interaction can create an unstable presentation of the articles and inconsistent shelf appearance. The articles can be knocked onto the floor or other unwanted areas, tipped over into a position that inadequately portrays the articles to the consumer, and potentially damaged, resulting in a loss of profit for the companies manufacturing and selling the articles. Adjacent products can also become intermixed, creating confusion for the consumer.

In an effort to improve the above deficiencies of stocking and selling articles, numerous containers have been designed and configured to act as display trays. The containers, housing a plurality of articles, can be placed onto a shelf in one step and minimize article displacement and/or damage. Examples of such containers are illustrated in the following: UK Patent Application Nos. 2,278,341 A and 2,233,316 A and U.S. Pat. Nos. 4,553,666 and 5,464,151. Disadvantages with these containers, and others not listed, include difficult and aesthetically unacceptable opening, inadequate protection during transportation and warehouse stacking, and unsatisfactory article portrayal and retention.

U.S. Pat. No. 5,803,348 attempts to address these disadvantages. The '348 patent discloses a container that can be converted into a display by removing a hood portion from a tray portion with one hand. When the hood portion is removed, an associated front wall of the tray portion is also totally removed, allowing an unobstructed view of, and access to, the housed articles. Two disadvantages are apparent from this design. First, by totally removing the front wall, articles are not protected from being knocked to the floor or other unwanted areas. Second, the single grasping means and direction of opening requires orientation.

UK Patent Application No. 2,162,820 A discloses a container having cut-away side walls on both a front and back region. A disadvantage of this design is that articles can fall out of the back of the container when opening and displaying.

Thus, there is still a need for a container that provides adequate protection during transportation and storage, yet is easily and cleanly opened for orderly display of the articles contained in it.

The present invention relates to a container having top and bottom sections linked by a continuous line of weakness, wherein the container top section can be removed and disposed of, while the container bottom section is retained for displaying contained articles. Opening of the container can conveniently begin from any side with the same end result. Additionally, the continuous line of weakness employs design features, such as a significant radius at points of directional change, and strength properties to provide consistent, easy, and clean opening to maintain operability and pleasing aesthetics during display. The continuous line of weakness is at a high vertical position on the back wall and two side walls to prevent the articles from being undesirably displaced when the container is open. On the other hand, the continuous line of weakness is at a relatively low vertical position on the front wall compared to that of the back wall and two side walls. This permits a sufficient balance between retaining the articles in the open container without displacement or damage and allowing for easy access by the consumer. Further, the container of the present invention employs materials and design features that provide satisfactory protection during transportation, clamping and stacking.

SUMMARY OF THE INVENTION

The present invention provides a container configured for shipping, storing, and displaying goods, comprising: a top wall, a bottom wall, two side walls, a front wall, a back wall, and corners defined by intersecting walls; each of the side walls, front wall, and back wall containing upper portions collectively forming with the top wall a container top section and lower portions collectively forming with the bottom wall a container bottom section; the container top and bottom sections being linked by a continuous line of weakness positioned parallel to and at the same vertical distance from the bottom wall on the back wall and two side walls, and positioned at a lower vertical distance from the bottom wall along a central region of the front wall; and wherein the continuous line of weakness has a radius of at least about 10 millimeters at locations of directional change on the front wall.

The present invention further provides a container configured for shipping, storing, and displaying goods, comprising: a top wall, a bottom wall, two side walls, a front wall, a back wall, and corners defined by intersecting walls; each of the side walls, front wall, and back wall containing upper portions collectively forming with the top wall a container top section and lower portions collectively forming with the bottom wall a container bottom section; and a perforated line of weakness linking the container top and bottom sections, wherein the perforated line of weakness has a radius of at least about 10 millimeters at locations of directional change on the front wall, and comprises land components from about 1.5 to about 4 millimeters in length and perforation components from about 1.5 to about 25 millimeters in length; wherein the container has a maximum compression value of at least about 50 pounds.

DETAILED DESCRIPTION OF THE INVENTION

Figure 1:
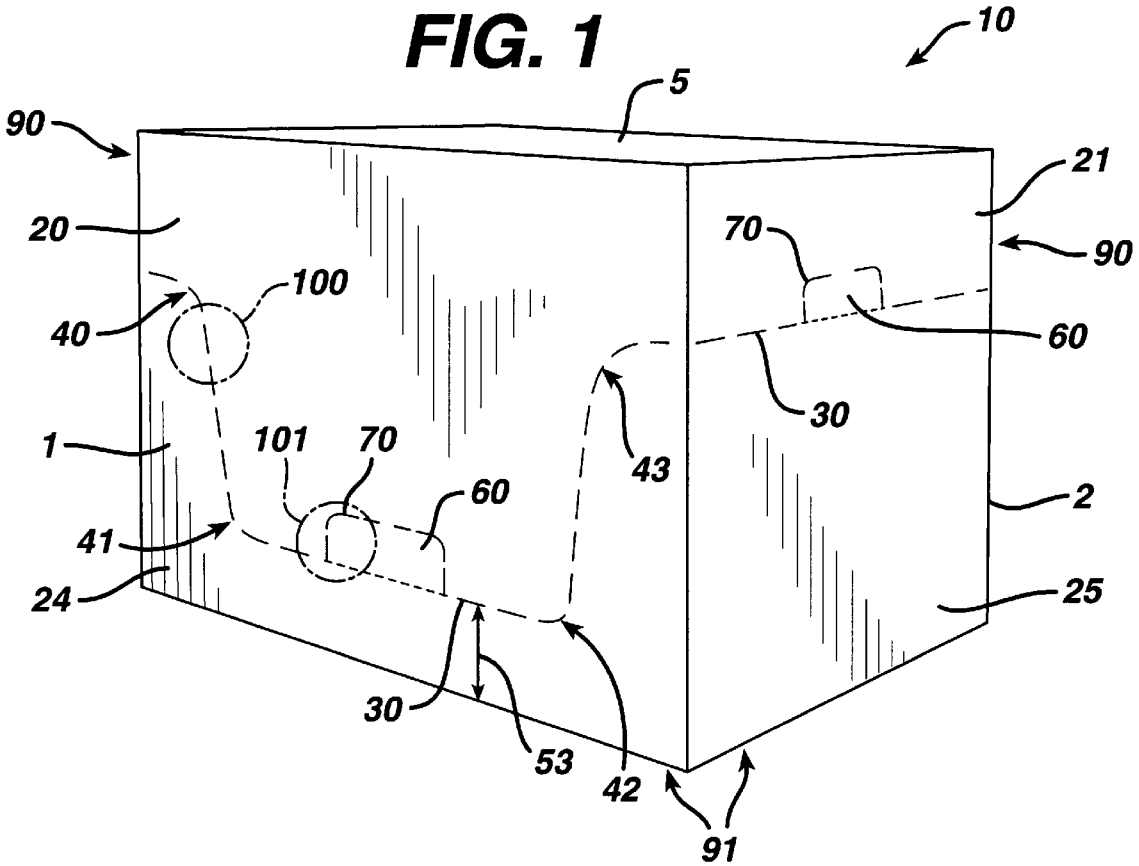
FIG. 1 is a perspective view of a container according to the present invention with both container top and bottom sections depicted, that is, in a closed state.
Figure 2:
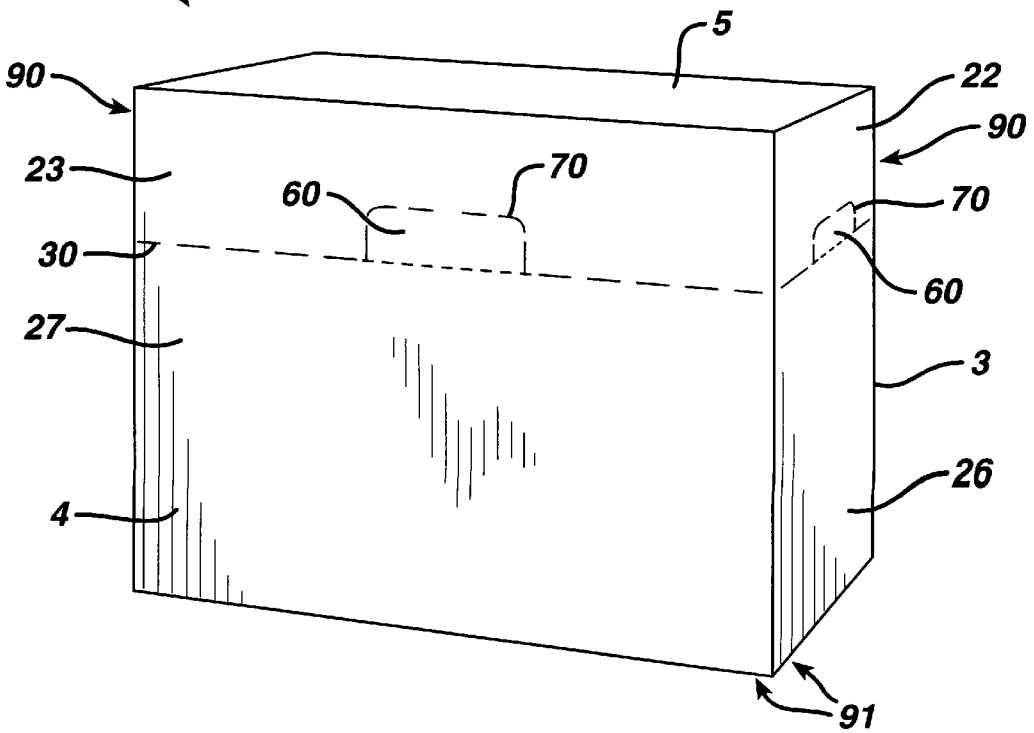
FIG. 2 is a back view of the container of FIG. 1, illustrating the position of the continuous line of weakness.
Figure 5:
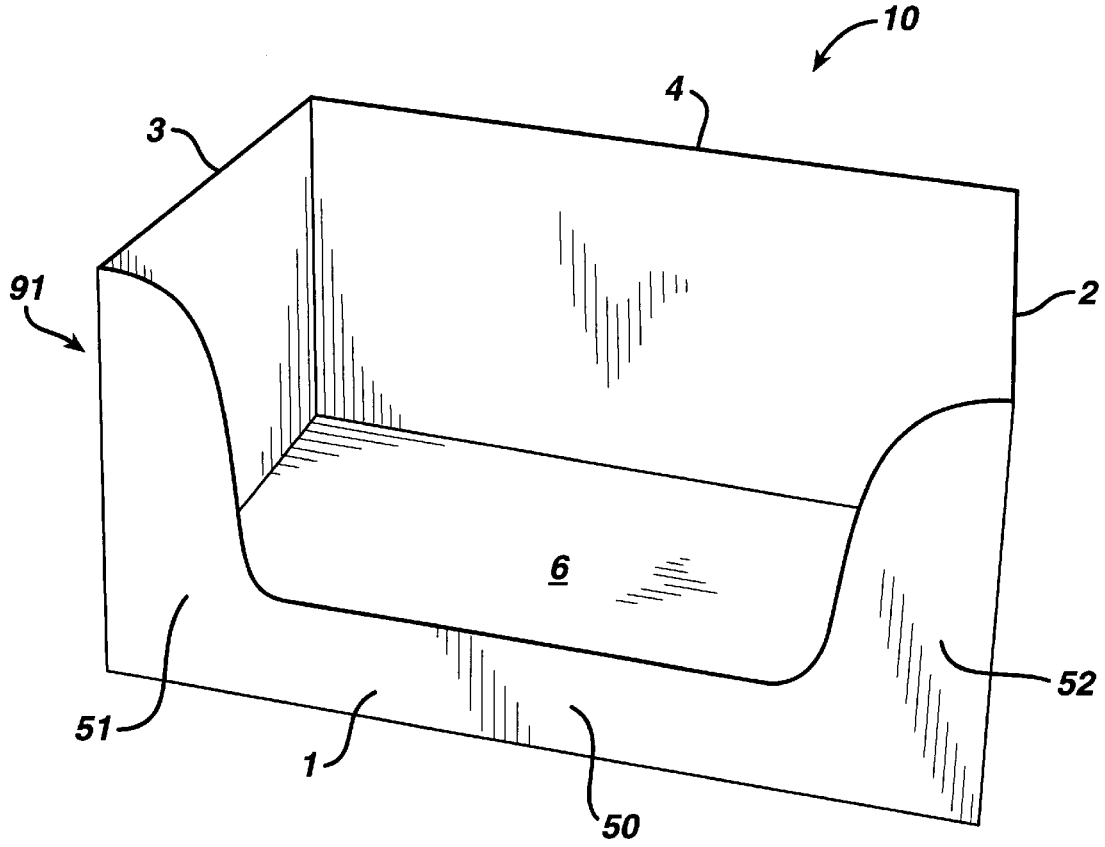
FIG. 5 is a perspective view of the container of FIG. 1, wherein the container top section has been removed, that is, in an open state for displaying articles.

A container 10 of the present invention is shown in FIGS. 1, 2 and 5, having a front wall 1, side walls 2 and 3, a back wall 4, and a top wall 5. A bottom wall 6 completes the container, for totally enclosing and protecting articles contained therein. Each of the front wall 1, two side walls 2 and 3, and back wall 4 contain upper portions 20, 21, 22 and 23 respectively, and lower portions 24, 25, 26 and 27 respectively. The upper portions 20, 21, 22 and 23 collectively form a container top section 90. The lower portions 24, 25, 26 and 27 collectively form a container bottom section 91. The container top section 90 and the container bottom section 91 are linked by a continuous line of weakness 30.

The continuous line of weakness 30 allows one to remove the container top section 90, while retaining the container bottom section 91 for displaying contained articles. The continuous line of weakness 30 can be made using any known mechanical means, such as scoring or perforating; chemical means, such as chemical etching; physical means, such as a laser; or combinations thereof. The continuous line of weakness 30 can be a single line, or alternatively a series of lines, such as those that make up a tear strip configuration. Preferably, the continuous line of weakness 30, is a perforated line as illustrated in the Figures.

The continuous line of weakness 30 has substantially constant resistance to separation along its length. For example, if the continuous line of weakness 30 is a scored line, then it is of constant depth and density. Alternatively, if the continuous line of weakness 30 is a perforated line, the dimensions of the perforation components and the land components residing between adjacent perforation components are constant. This can be seen more readily in FIG. 3. The properties of the continuous line of weakness 30 may vary slightly in the corners of the container to impart strength properties as described more fully below.

Figure 3:
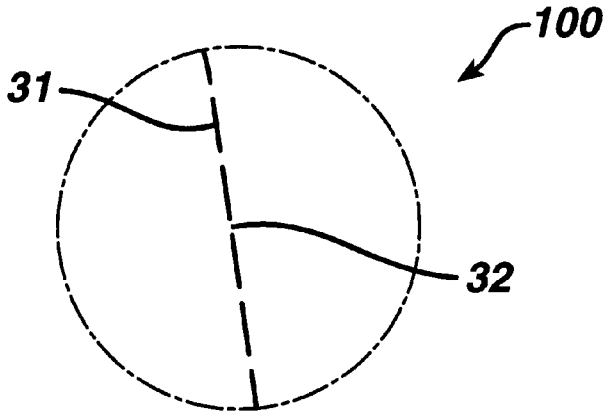
FIG. 3 is an enlarged view of the continuous line of weakness in FIG. 1.

FIG. 3 is an enlarged view of area 100 of FIG. 1, illustrating a preferred embodiment of the continuous line of weakness 30 comprising perforation components 31 and land components 32. The dimensions of the perforation components 31 and land components 32 are preferably adjusted to ensure protection of the articles prior to removing the container top section 90, while allowing easy and clean opening of the container. The perforation components 31 of the continuous line of weakness 30 are preferably about 1.5 to about 25 millimeters in length, more preferably about 10 to about 15 millimeters in length. The land components 32 of the continuous line of weakness 30 are preferably from about 1.5 to about 4 millimeters in length, more preferably from about 2.5 millimeters to about 3.5 millimeters in length.

In addition, the continuous line of weakness 30 has a minimum radius at points of directional change of at least about 10 millimeters, which only occur on the front wall 1 of the container. Points of directional change, as used herein, do not include the corners of the container. The minimum radius aids in the ease and clean removal of the container top section 90 from the container bottom section 91. The radius at points of directional change is preferably about 20 to 50 millimeters. FIGS. 1 and 2 depict points of directional change 40, 41, 42 and 43 of the continuous line of weakness 30, on the front wall 1.

The vertical position of the continuous line of weakness 30 on the front wall 1, back wall 4, and side walls 2, 3 is set to provide proper retention of contained articles and an unobstructed view of, and access to, articles housed by the container. As seen in FIGS. 1, 2 and 5, the continuous line of weakness 30 runs parallel to and at the same vertical distance from the bottom wall 6 on the back wall 4 and two side walls 2 and 3. However, the continuous line of weakness 30 changes direction on the front wall 1 such that it is positioned at a lower vertical distance from the bottom wall 6 along a central region of the front wall 1, compared to its position on the back wall 4 and two side walls 2 and 3. The central region 50 of the front wall 1 preferably comprises from about 50 to about 95 percent of the front wall's area, more preferably from about 80 to about 90 percent of the front wall's area. Complementary front wall regions 51 and 52 preferably combine to make up the remaining 5 to 50 percent of the front wall. When the container is open, the complementary front wall regions 51 and 52 provide at least some obstruction of articles inside the container adjacent the side walls 2 and 3, thereby aiding in the retention of the articles prior to consumer retrieval as illustrated in FIG. 5.

The height 53 of the lower portion of the central region 50 should be sufficient to provide retention of the articles in the container, including during removal of the container top section 90, so as not to allow severe distortion of the articles inside. For example, in a container having a closed height of approximately 200 to 300 millimeters, height 53 is approximately 20 millimeters.

Grasping members can be optionally employed to aid in the removal of the container top section 90 from the container bottom section 91. Preferably, the present invention employs at least one grasping member 60 on each of the upper portions 24–27, allowing separation to begin from any position. More preferably, the grasping members are positioned adjacent the continuous line of weakness 30. Thus, a person can engage the grasping members 60 and begin separation of the container top section 90 from the container bottom section 91, all in one step. The grasping members 60 are defined by secondary lines of weakness 70. Each secondary line of weakness 70 may exhibit a uniform resistance to separation along its entire length, or alternatively vary in resistance to separation along its length. Preferably, each secondary line of weakness 70 varies in resistance to separation along its length, allowing each grasping member 60 to be only partially disassociated from the walls (that is, separated along a first region and rotatably displaced along one or more remaining regions of secondary line 70). This avoids separate disposal issues.

Figure 4:
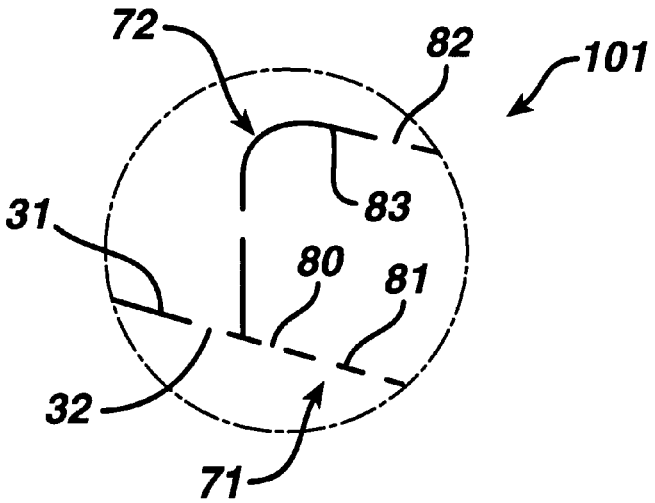
FIG. 4 is an enlarged view of an optional grasping member on the container of FIG. 1.

In a preferred embodiment of the invention, the secondary lines of weakness are perforated lines, each lines having a varying resistance to separation along its length by virtue of having land components and perforation components of varying dimensions. In this embodiment, the secondary lines of weakness 70 allow the grasping members 60 to be partially disassociated from their respective walls. FIG. 4 is an enlarged view of area 101 of FIG. 1. Each grasping member has a first region 71 comprising land components 80 and perforation components 81, and a second region 72 comprising land components 82 and perforation components 83. The length of land components 80 is significantly less than that of land components 82. Preferably, the length of land components 80 is approximately 2 millimeters, the length of land components 82 is approximately 15 millimeters, and the length of perforation components 81 and 83 is approximately 5 millimeters. These dimensions may vary and it should be noted that the dimensions and geometry of the grasping members 60 are not critical to the present invention. However, the above preferred dimensions allow for easy, unassisted disassociation of the grasping members 60.

The grasping members 60 should be of sufficient size and geometry to readily receive at least one human finger. Various other tools, such as a hook, could be inserted into grasping members 60 for removing the container top section 90 from the container bottom section 91.

The container of the present invention has a maximum compression of at least about 50 pounds, preferably greater than about 100 pounds, and more preferably greater than about 200 pounds, according to ASTM 4169, entitled "Standard Practice for Performance Testing of Shipping Containers and Systems." ASTM 4169 yields a maximum compression value as one of its outputs.

A representative, non-limiting list of materials useful in constructing the container includes corrugated board, paperboard, polymeric sheeting, foam, and combinations thereof. The preferred material is corrugated board. Preferably, the corrugated board comprises C-flute corrugations. Further, the corrugated board preferably has a Mullen Burst Strength value of about 125 to about 250 pounds per square inch (approximately equal to Edge Crush Test (ECT) values from about 20 to about 40 ECT). Further, the corrugated board comprises C-flute corrugations with the material weight combination of 42-30-33 pounds per thousand square feet. The type of fluting (A, B, C, and E, and combinations thereof) and Mullen Burst Strength required to provide both protection during shipping and storing, and clean and easy opening, can vary according to the weight of articles inside the container.

Both the properties of the materials of construction of the container and the properties of the continuous line of weakness may effect the maximum compression of the container. For example, where the continuous line of weakness is a perforated line, the range of preferred dimensions of the land components and perforation components described above also maintain the strength of the container. To further enhance the maximum compression of the container, the corners of the container should preferably contain only land components. Further, the perforation components most proximal the corners of the container are preferably at least 2 millimeters from the corner, and more preferably at least 8 millimeters from the corner.

EXAMPLE

The following is an example of a container within the scope of the present invention, which yielded extremely positive qualitative and quantitative values for ease of opening, appearance after opening, and container strength. The container was constructed with corrugated board having a Mullen Burst Strength of 175 pounds per square inch, and comprising C-flute corrugations. The continuous line of weakness was a perforated line having land components 3 millimeters in length and perforation components 15 millimeters in length. The perforation components most proximal the corners were a distance of 10 millimeters from the corners. The average maximum compression value, according to ASTM 4169, was 261 pounds.

Four individuals were recruited to open 5 containers each constructed as above. The average value reported by the individuals was 2.35, on a qualitative scale from 1 to 5, 1 being extremely easy to open, and 5 being extremely difficult to open. The appearance after opening was rated excellent to very good for the same twenty containers, translating to a clean appearing exposed edge (interface of the upper and lower portions), having no or very little ragged points along the exposed edge. None of the containers suffered premature separation along the continuous line of weakness when clamped. Further, there was only one instance of damage, along the continuous line of weakness, during a shipping trial (land) of approximately 500 miles.

The container of the present invention is useful for shipping, storing, and displaying a wide range of articles, including but not limited to consumer products, such as disposable absorbent articles, hair care products, skin care products, and baby products; and pharmaceutical products, such as over the counter analgesics and cough/cold/influenza remedies. Articles contained in the container of the present invention may be individually packaged, or packaged in groups of at least 2 articles. The individual packaging may be in the form of bottles, cans, pouches, sachets, bags, boxes, and the like. The container of the present invention may contain a single row of articles, or multiple rows of articles.

The container of the present invention may optionally contain graphics on the outwardly disposed surfaces, illustrating preferred opening instructions. The optionally employed graphics may also relate to the contained articles, including information additional to that on the articles or packaging inside. The graphics may indicate how the contained articles relate to a system in which multiple articles can be combined for use according to various uses and needs.

The container can be placed onto a shelf or onto other various display configurations, such as in aisle or end of aisle stands. Multiple open containers can be stacked on one another in a high-volume stocking scenario.

The disclosures of all patents, as well as any corresponding published foreign patent applications, mentioned throughout this patent application are hereby incorporated by reference herein.

What is claimed is:

1. A container configured for shipping, storing, and displaying goods, comprising: a top wall, a bottom wall, two side walls, a front wall, a back wall, and corners defined by intersecting walls; each of the side walls, front wall, and back wall containing upper portions collectively forming with the top wall a container top section and lower portions collectively forming with the bottom wall a container bottom section; the container top and bottom sections being linked by a continuous line of weakness positioned parallel to and at the same vertical distance from the bottom wall on the back wall and two side walls, and positioned at a lower vertical distance from the bottom wall along a central region of the front wall; and wherein the continuous line of weakness has a radius of at least about 10 millimeters at locations of directional change on the front wall.

2. The container of claim 1 having a maximum compression value of at least about 50 pounds.

3. The container of claim 1 further comprising at least one grasping member positioned on the upper portion of each of the side walls, the front wall, and the back wall, the grasping members being coplanar with the walls and being defined by secondary lines of weakness, wherein the grasping members can be at least partially disassociated from the walls.

4. The container of claim 1 made from corrugated board.

5. The container of claim 4 wherein the corrugated board has a Mullen Burst Strength value of about 125 to about 250 pounds per square inch.

6. The container of claim 4 wherein the corrugated board comprises C-flute corrugations.

7. The container of claim 1 wherein the continuous line of weakness is a perforated line comprising land components and perforation components.

8. The container of claim 7 wherein each land component is about 1.5 to about 4 millimeters in length.

9. The container of claim 7 wherein each perforation component is about 1.5 to about 25 millimeters in length.

10. The container of claim 7 wherein the corners comprise only land components.

11. The container of claim 10 wherein the perforation components most proximal the corners are positioned at least 2 millimeters from the corner.

12. The container of claim 1 housing a plurality of goods.

13. The container of claim 12 wherein the goods are individual packages of at least 2 articles.

14. The container of claim 12 wherein the goods comprise disposable absorbent articles.

15. A container configured for shipping, storing, and displaying goods, comprising:

a) a top wall, a bottom wall, two side walls, a front wall, a back wall, and corners defined by intersecting walls; each of the side walls, front wall, and back wall containing upper portions collectively forming with the top wall a container top section and lower portions collectively forming with the bottom wall a container bottom section; and b) a perforated line of weakness linking the container top and bottom sections, wherein the perforated line of weakness has a radius of at least about 10 millimeters at locations of directional change on the front wall, and comprises land components from about 1.5 to about 4 millimeters in length and perforation components from about 1.5 to about 25 millimeters in length;

wherein the container has a maximum compression value of at least about 50 pounds.

16. The container of claim 15 wherein the perforated line of weakness is positioned parallel to and at the same vertical distance from the bottom wall on the back wall and two side walls, and positioned at a lower vertical distance from the bottom wall along a central region of the front wall.

17. The container of claim 15 further comprising at least one grasping member positioned on the upper portion of each of the side walls, the front wall, and the back wall, the grasping members being coplanar with the walls and being defined by secondary lines of weakness, wherein the grasping members can be at least partially disassociated from the walls.

18. The container of claim 15 made from corrugated board having C-flute corrugations, and having a Mullen Burst Strength value of about 125 to about 250 pounds per square inch.

19. The container of claim 15 housing a plurality of goods.

* * * * *

UNITED STATES PATENT AND TRADEMARK OFFICE
CERTIFICATE OF CORRECTION

PATENT NO. : 6,073,833
DATED : June 13, 2000
INVENTOR(S) : Desrosiers et al.

It is certified that error appears in the above-identified patent and that said Letters Patent are hereby corrected as shown below:

Title Page: Section [75] Inventors, line 4: please delete "Flatmann" and insert therefor -- Flathmann -- .

Signed and Sealed this

Eighth Day of May, 2001

*Attest:*

Nicholas P. Godici

NICHOLAS P. GODICI

*Attesting Officer*

*Acting Director of the United States Patent and Trademark Office*